US010844714B2

(12) United States Patent
Justen et al.

(10) Patent No.: US 10,844,714 B2
(45) Date of Patent: Nov. 24, 2020

(54) TUNNEL BORING MACHINE OPERATING ARRANGEMENT AND METHOD

(71) Applicant: Tunnel Service Group GmbH, Dueren (DE)

(72) Inventors: Ingo Justen, Noervenich (DE); Christoph Winkler, Aachen (DE)

(73) Assignee: Tunnel Service Group GmbH, Dueren (DE)

( * ) Notice: Subject to any disclaimer, the term of this patent is extended or adjusted under 35 U.S.C. 154(b) by 190 days.

(21) Appl. No.: 15/987,134

(22) Filed: May 23, 2018

(65) Prior Publication Data

US 2019/0063219 A1 Feb. 28, 2019

(30) Foreign Application Priority Data

May 23, 2017 (DE) ..... 10 2017 111 213

(51) Int. Cl.
*E21D 9/10* (2006.01)

(52) U.S. Cl.
CPC ..... *E21D 9/1086* (2013.01); *E21D 9/10* (2013.01); *E21D 9/1093* (2013.01)

(58) Field of Classification Search
CPC ..... E21D 9/1086; E21D 9/10; E21D 9/1093; E21D 1/06; E21D 9/08; E21D 9/087; E21D 9/1006; E21B 7/028
USPC ..... 405/138; 299/55, 58
See application file for complete search history.

(56) References Cited

U.S. PATENT DOCUMENTS 4,630,967 A * 12/1986 Soltau ..... E21B 7/201 405/143
5,236,054 A * 8/1993 Jack ..... E21B 7/028 175/57
5,553,680 A * 9/1996 Hathaway ..... E21B 7/02 175/162
7,832,960 B2 * 11/2010 Home ..... E21D 9/001 299/33

* cited by examiner

*Primary Examiner* — Tara Schimpf
*Assistant Examiner* — Jonathan Malikasim
(74) *Attorney, Agent, or Firm* — Von Rohrscheidt Patents

(57) ABSTRACT

An operating arrangement for operating a tunnel boring machine for constructing a tunnel in a ground, the operating arrangement including a feed drive that is configured to advance the tunnel boring machine in the ground; a tool drive that is configured to drive a mining tool of the tunnel boring machine so that a successive removal of the ground is performable; at least one fluid tank for storing a drive fluid; at least one filtering arrangement for filtering the drive fluid; at least one cooling arrangement for cooling the drive fluid; and at least one control arrangement by which the feed drive and/or the tool drive is controllable wherein at least the feed drive and the tool drive are jointly arrangeable in a container.

15 Claims, 3 Drawing Sheets

TUNNEL BORING MACHINE OPERATING ARRANGEMENT AND METHOD

RELATED APPLICATIONS

This application claims priority from and incorporates by reference German patent application DE10 2017 111 213.8 filed on May 23, 2017 which is incorporated in their entirety by this reference.

FIELD OF THE INVENTION

The instant application relates to an arrangement for operating a tunnel boring machine for constructing a tunnel in a ground, the device comprising:

- a feed drive that is configured to advance the tunnel boring machine in the ground;
- a tool drive that is configured to drive a mining tool of the tunnel boring machine so that a successive removal of the ground is performable,
- at least one fluid tank for storing a drive fluid;
- at least one filtering arrangement for filtering the drive fluid;
- at least one cooling arrangement for cooling the drive fluid;
- at least one control arrangement by which the feed drive and/or the tool drive is controllable, wherein at least the feed drive and the tool drive are jointly arrangeable or arranged in a container. The instant application relates in particular to operating arrangements for producing so called utility tunnels whose interior diameter is typically in a range of 0.2 meters and 5.0 meters.

The instant application furthermore relates to a method for producing a tunnel in a ground using a tunnel boring machine.

Ground according to the instant application is soil as well as rocky soil, e.g. rock. In a portion of a geodetical rise the ground according to the instant application can also terminate flush with a subsequent upper edge of the ground. In tunnels of this type the tunnel boring machine is run directly from an elevation of the upper edge of the ground into a rise, e.g. a mountain.

The feed drive according to the instant invention designates the drive that is configured to push the tunnel boring machine forward in the ground. Typically, the feed drive includes a hydraulic power supply by which a feed press is drivable. This feed press can impact the tunnel boring machine either directly or indirectly and can push it forward in the ground so that the tunnel boring machine moves along a longitudinal axis of the tunnel that is being built.

The tunnel boring machine as such includes at least one mining tool that is configured to remove the respective ground so that the tunnel is produced. The mining tool can be configured in particular by a cutting wheel that is driven to rotate about a rotation axis that is parallel to the longitudinal axis of the tunnel wherein cutting boxes arranged at the cutting wheel engage the material of the ground and successively remove the ground. It is appreciated that mining tools according to the instant application are all tools that are configured to remove ground.

In analogy to the feed drive the "tool drive" according to the instant application is a drive by which the mining tool is drivable. The tool drive is typically formed by a hydraulic power supply which is operatively connected by hydraulic conduits with a motor of the mining tool.

A container according to the instant application is a physical unit which encloses an interior space in an outward direction by space limitation elements, in particular by walls, a ceiling and a floor relative to the ambient. In particular such containers can be formed by sea containers which are easily road transportable by trucks. In an embodiment of this type the operating arrangement as such can be transported particularly easily between two different set up locations.

BACKGROUND OF THE INVENTION

Operating arrangements of the type described supra are known in the art. They can be designated as so called compact containers wherein a compact container of this type houses the operating arrangement recited supra in its entirety within a single container and the compact container is set up on a construction site. The respective tunnel boring machine that is to be used for producing the respective tunnel is then connected to the compact container by hydraulic conduits so that a respective mining tool of the tunnel boring machine is flow connected with the tool drive. Driving the tool drive facilitates driving the mining tool. Parallel thereto a respective feed press is driven by the feed drive so that the tunnel boring machine in its entirety is moved in the ground in a direction of a planned tunnel axis.

Operating the tool drive within the container becomes problematic as soon as the tunnel to be produced exceeds a particular threshold length. Thus, it is appreciated that the hydraulic conduits by which the mining tool is connected with the tool drive have to be configured with a commensurate length to follow the progressing feed of the tunnel boring machine in the ground since a distance between the compact container and the tunnel boring machine increases. With increasing length of the tunnel there is a problem that friction losses within the hydraulic conduits increase to a value where fluid pressure of the drive fluid that effectively arrives at the mining tool is not sufficient to drive the motor of the mining tool as intended.

In order to solve this problem operating arrangements are furthermore known in the art where the tool drive is run behind the mining tool together with associated components within the tunnel. Put differently the tool drive as such is moved in the same way within the tunnel in which the tunnel boring machine is moved. This way the hydraulic conduits by which the tool drive is connected with the mining tool can be permanently kept at a small length independently from the length of the tunnel to be produced. External drives of this type for the mining tool that are run within the tunnel can also be designated as so called tunnelling units. Thus, it is appreciated that no compact container is actually required to operate the respective tunnel boring machine since the tool drive arranged in the compact container is not suitable to drive the mining tool over an entire length of the respective tunnel. Accordingly, so called press containers are often used which only include the feed drive and the associated components in order to be able to operate the respective feed press.

An alternative solution is to have a compact container for producing a long tunnel wherein the compact container is exclusively used for driving a feed drive for operating the feed press while the tool drive that is arranged in the compact container is shut down. The tool drive is provided by an additional tunnelling unit that is run behind the mining tool.

Overall a plurality of individual operating arrangements or components has to be kept on hand for prior art solutions as a function of respective individual tunnels wherein an excessive number of drives has to be kept on hand in many cases for producing a single tunnel wherein at least one tool drive is not used at all which significantly degrades economics.

BRIEF SUMMARY OF THE INVENTION

Thus, it is an object of the instant invention to provide an operating arrangement and a method for producing a tunnel which facilitate producing tunnels in a manner that is more efficient than the prior art.

The object is achieved according to the invention in that the tool drive is removable from the container. Therefore, it is essential for the invention that the operating arrangement includes a second fluid tank wherein one of the fluid tanks is associated with the feed drive and the other fluid tank is associated with the tool drive. The fluid tank associated with the tool drive then forms a tool drive module together with the tool drive wherein the tool drive module is removable from the container in its entirety. This way the tool drive can be operated independently inside and outside of the container.

Removing the tool drive module from the container is therefore advantageously facilitated in that an operating connection between the tool drive and the associated fluid tank is permanently provided. This operating connection is in particular provided by hydraulic conduits which facilitate changing a drive fluid, in particular on oil between the tool drive and the fluid tank. In particular an embodiment is advantageous where the tool drive and the fluid tank do not change their relative positions when the tool drive module is retrieved.

The operating arrangement according to the invention has many advantages. Differently from the prior art the operating arrangement facilitates in particular that the operator of the operating arrangement can choose as a function of the tunnel to be produced whether he operates the tool drive within the container or removes it from the container and runs it like a tunneling unit within the tunnel behind the mining tool. This way it is not necessary for the operator to keep a plurality of different operating arrangements on hand, e.g. a compact container as well as a press container as well as a separate tunneling unit so that individual operating arrangements are not being used at least temporarily since they are not usable or suitable for a respective construction project. Put differently the invention facilitates reducing investment in tooling that is required for providing tunnel construction services.

It is another advantage of the operating arrangement according to the invention to have a second fluid tank which is used as a matter of principle for operating the tool drive, this means also when the tool drive or the tool drive module is arranged within the container. This condition is very similar to the compact container described supra wherein the feed drive as well as the tool drive is permanently arranged within the container. Differently from the compact container the operating arrangement according to the invention, however, permanently includes separate fluid tanks for the feed drive and the tool drive while both drives share a common fluid tank when using the compact container. The latter is detrimental in that the respective drive fluid which is stored in the common fluid tank has to be completely replaced each time when it is contaminated. Contaminations of this type typically occur at an entry of the tunnel that is being produced since the hydraulic conduits which are run from the tool drive to the mining tool have to be separated and then coupled again each time an additional tube segment of the tunnel is inserted. Thus, an increased amount of contamination is introduced into the hydraulic conduits and that amount of contamination eventually accumulates in the joint fluid tank. As a result the entire common drive fluid of the feed drive and of the tool drive has to be replaced in the prior art though the feed drive as such hardly contributes at all to the contamination of the drive fluid in the common fluid tank.

In the embodiment according to the invention the fluid tank of the feed drive is insulated from the fluid tank of the tool drive, thus also when the tool drive module is operated within the container. This eventually has the effect that replacing drive fluid due to strong contamination only has to be performed for the tool drive, whereas the drive fluid of the feed drive can remain in its fluid tank. Thus, cost of new drive fluid and environmental impacts when replacing the drive fluid can be significantly reduced. Furthermore wear of the feed drive due to contaminated drive fluid is significantly reduced. The drive fluid of the feed drive is not impaired by the heat introduction from the mining tool when the fluid tanks are provided separately.

In an advantageous embodiment of the operating arrangement according to the invention the tool drive module is removable from the container so that at least the tool drive and the associated fluid tank do not change positions relative to each other during removal. In particular a distance between the tool drive and the associated fluid tank does not change during removal of the tool drive module from the container. Advantageously this applies for all components of the tool drive module. Such components can be e.g. an associated cooling arrangement, a filter arrangement, a control unit and similar in addition to the tool drive and the associated fluid tank. This will be described in detail infra.

The operating arrangement further includes the tool drive module, a carrier unit on which at least the tool drive and the associated fluid tank are arranged. In a particularly advantageous manner the fluid tank is directly used as a carrier unit and thus performs a double function, namely storing the drive fluid and carrying components of the tool drive module. If the carrier unit is formed by the fluid tank the fluid tank according to the instant invention is arranged on the carrier unit.

Advantageously all components of the tool drive module are arranged on the carrier unit. This has a particular advantage in that only the carrier unit as such has to be disengaged for retrieving the tool drive module from the container and can thus be removed in its entirety from the container. Put differently, the tool drive module can be disengaged from the container by disengaging one or plural centrally arranged connectors so that the tool drive module is retrievable in its entirety. Disengaging individual connectors that directly cooperate with individual components of the tool drive can thus be omitted.

Vice versa after retrieving the tool drive module, it can be reinserted into the container in that the carrier unit including the remaining tool drive modules is inserted into the container and attached therein by connectors. It is appreciated that the components of the tool drive module arranged on the carrier unit maintain their relative orientation in a particularly advantageous embodiment. In particular the tool drive module including its carrier unit shall be configured so that no dismounting of individual components of the tool drive module is necessary for retrieving the tool drive module, but the retrieval can be performed solely by dismounting the superordinate carrier unit on which the components of the tool drive module are arranged.

Using the carrier unit described supra it is furthermore advantageous when the container includes a receiver for the tool drive module wherein the receiver is adapted to the carrier unit so that the carrier unit is mountable in or at the receiver without reconfiguration and vice versa also dismountable from the receiver without a reconfiguration. Mountable and dismountable without reconfiguration according to the instant application means that the tool drive module as such does not have to be adapted in order to be retrieved from the container or in order to be reinserted into the container. Consequently embodiments where one or plural other components have to be dismounted separately and then mounted again after retrieval of the tool drive module have theft disadvantages. Instead the interaction between the container and the tool drive module should be as simple as possible using a minimum number of connection devices so that a quick and simple installation and removal of the tool drive module can be performed.

Further configuring the operating arrangement according to the invention it includes a control unit which is associated with the tool drive and which includes a connection with the control arrangement which can in particular be permanently mounted in the container. Thus, the control unit cooperates with the tool drive directly so that it can process control signals received by the control arrangement and can thus electrically control the tool drive or individual components thereof. A control unit of this type is advantageously configured as a component of the tool drive module and furthermore installed together with the tool drive and the associated fluid tank on a common carrier unit. The control unit has the particular advantage that the tool drive module in its uninstalled condition where it is run behind the mining tool only requires a very small number of connection conduits with the container or of the control arrangement installed therein. In particular it is typically sufficient to run only one single data conductor from the control arrangement to the control unit and to process control signals run through this data conductor only at the tool drive module on site and to divide the data conductor for controlling the individual components of the tool drive module. This way the control unit facilitates particularly simple external operations of the tool drive module outside of the container.

In a particularly advantageous embodiment the control unit cooperates with a maximum of three input conduits which connect the control unit with the container. At least one of the input conduits is formed by the data conduit recited supra. Furthermore at least one input conduit is formed by an electrical conductor which provides the control unit with electrical current. Thus, it can be advantageous when the control unit furthermore requires an additional electrical conductor, wherein the two electrical conductors respectively provide an electrical current on different voltage levels, in particular at 400 V and 960 V. Thus, input conduits according to the instant application are only conduits which are operatively connected with the control unit. Thus, conduits that are not significant or ineffective for operations and effectiveness of the control unit are also connected to the control unit, possibly only surface connected are not input conduits according to the instant application.

In another advantageous embodiment of the operating arrangement according to the invention the operating arrangement includes a second cooling arrangement that is associated with the tool drive. The second cooling arrangement is advantageously also configured as a component of the tool drive module and furthermore also arranged on a common carrier unit together with the remaining components of the tool drive module. The second cooling arrangement has the advantage that the drive fluid of the tool drive can be cooled directly at the tool drive module. In particular returning the drive fluid into the container in order to use the cooling arrangement installed therein is not required.

Thus, it is of secondary importance for obtaining the advantages provided by the invention in which manner the second cooling arrangement is configured. The second cooling arrangement can be configured in particular in multiple stages, wherein a direct cooling of the drive fluid is performed e.g. by a liquid liquid heat exchanger where heat is transferred from the drive fluid to a coolant, e.g. glycol. This coolant can then be cooled in a second stage by another liquid—liquid heat exchanger, wherein the heat can be transferred to water in particular. Thus, in particular using so called feed water is feasible which is used for operating the tunnel boring machine in the portion of the mining tool. This feed water can then remove heat from the drive fluid at least indirectly in a secondary function. Alternatively, it is also conceivable for the second stage of the cooling arrangement to cool the coolant by an air-liquid heat exchanger. It is appreciated that a plurality of other variants is conceivable, e.g. an indirect cooling of the drive fluid by an air—liquid heat exchanger or an indirect cooling of the drive fluid by the feed water.

Furthermore an operating arrangement can be particularly advantageous that includes a second filtering arrangement that is associated with the tool drive and which is useable for filtering the drive fluid that is stored in the second fluid tank. Thus, the second filtering arrangement is directly flow connected with the second fluid tank. It is appreciated also here that the second filtering arrangement is advantageously configured as a component of the tool drive module.

Furthermore an operating arrangement can be advantageous which includes at least one transformer which is associated with the tool drive, advantageously only associated with the tool drive. A transformer of this type advantageously provides a base voltage of 960 volts. The high voltage is helpful to cover rather long distances between the container and the tool drive since resistance loses when using a lower voltage level would otherwise not be acceptable over long transmission distances and electrical conductors with a significantly enlarged cross section would have to be used. Therefore, in the prior art a transformer of this type is not required in combination with compact containers since the tool drive is in any case arranged directly in the container. Therefore, there are no long conductive paths. According to the invention the tool drive of the operating arrangement according to the invention is supplied with a voltage of 960 volts or is connected to the transformer that provides 960 volts independently from its location of application, this means either within the container or outside of the container. This way the tool drive module is suitable in any case to be supported in a tunnel, wherein a distance between the tool drive module and the container can be significant.

The object is achieved according to the invention by a method comprising the steps:

a) retrieving a tool drive module which includes at least one tool drive and a fluid tank that cooperates with the tool drive from a container which furthermore includes a feed drive in addition to the tool drive, wherein the tunnel boring machine is moved forward in the ground by the feed drive at least in increments;

b) inserting the tool drive module into the first tunnel that is being produced;

c) running the tool drive module behind a mining tool during a tunnel advance.

The method according to the invention can be performed in a particular simple manner by the operating arrangement according to the invention. The method has the particular advantage that the tool drive module is usable in an operating mode for "short tunnels" as well as for "long tunnels" in that the tool drive module is optionally retrieved from the container and inserted into the container. Thus, the essential method step according to the invention includes taking the tool drive module out of a container. This is not possible in the prior art when using a typical compact container and when using a typical tunnelling unit.

Thus, the method is particularly advantageous when the tool drive module is inserted into the container again in a time period after finishing a respective tunnel and before producing another tunnel. Put differently it is up to the operator of the respective operating arrangement to retrieve the tool drive module from the container or to reinsert it. In particular the operator can decide depending on the installation situation how he would like to proceed.

In particular when producing a long tunnel in which the tool drive module is retrieved from the container for producing the tunnel and then inserted into the tunnel it can be particularly advantageous to cool the drive fluid of the tool drive during a start-up period by a first cooling arrangement that is permanently installed in the container and to cool it during a propulsion period that comes after the start up period by a second cooling arrangement that is arranged at the tool drive module. The "start-up period" thus describes a time period in which an initial section of the tunnel is produced. Typically, this startup section adjoins directly to a start-up shaft from which the respective tunnel is introduced into the ground. Typically, the startup period includes introducing the tunnel boring machine into the ground and introducing a tube that follows behind the tunnel boring machine and that does not remain the ground permanently. It is appreciated that no tunnel section was produced yet in this condition into which the tool drive module could be inserted.

The described method is particularly advantageous over the prior art. According to the prior art a tunnelling unit is used for producing a long tunnel as described supra wherein the tunnelling unit is arranged outside of the container in any case. In order to cool the tunnelling unit typically the feed water is being used that is described supra. Thus, a feed water conduit is connected to the tunnelling unit so that the feed water conduit can cool the tunnelling unit, or the drive fluid used in the tunnelling unit. This method is disadvantageous within the described start up period for several reasons. On the one hand side coupling the tunnelling unit is rather complicated since the feed water conduit has to be interrupted at the location of the tunnelling unit. As soon as the tunnelling unit is inserted into the tunnel the feed water conduit has to be coupled at the location of the tunnelling unit. Furthermore, handing the feed water conduit as such is rather complex since it is a conduit with a rather large diameter and with high stiffness. In particular on small construction sites which have to be operated e.g. in road construction in a restricted space it can be rather complex to connect a tunnelling unit in the feed water conduit.

The method according to the invention, however, provides a cooling of the drive fluid of the tool drive by the cooling arrangement that is installed in the container, this means by the cooling arrangement that is associated with the feed drive. Put differently the tool drive module can be connected to the cooling device of the container during the start-up period so that connecting the tool drive module into the feed water conduit as typically required in the prior art can be omitted. Thus, the construction method is significantly simplified and accelerated during the start-up period of the tunnel to be produced.

Thus, advantageously the drive fluid of the tool drive is cooled during the start-up period at least indirectly by an air liquid heat exchanger and during the propulsion period by an operating fluid of the tunnel boring machine. The operating fluid can be in particular the feed water described supra that is used for extracting material at the mining tool. Advantageously the drive fluid of the tool drive is cooled during the start-up period directly by the air-liquid heat exchanger, namely by the cooling arrangement that is permanently installed in the container. Thus, a small amount of mixing of the drive fluids of the feed drive and of the tool drive can occur in spite of an otherwise complete separation of the loops of the drive fluids.

Cooling the drive fluid of the tool drive during the propulsion period is advantageously only performed indirectly by a cooling stage that is connected in between. This is due to the fact that the cooling by the operating fluid of the tunnel boring machine is subject to a realistic risk of getting damaged which is caused by the high loading of the operating fluid with abrasive components. The latter can be formed in particular by mining products that are generated in the course of production of the tunnel. These abrasive components can grind through an operating fluid conductor over time. Since it is typical to have the conductor of the operating fluid enveloped directly with the respective coolant flow the described grind through of the conductor of the operating fluid would cause a direct introduction of the operating fluid of the tunnel boring machine into the coolant. The direct cooling of the operating fluid would mean in the context that damaging the operating fluid conductor directly introduces the operating fluid into the coolant. This introduction bears the risk of environmental damages. Vice versa components of the coolant can get into the operating fluid which can lead to non-repairable damages to the tool drive.

Thus, it is advantageous to provide a secondary cooling loop that is configured with a comparatively harmless coolant e.g. glycol. In this constellation thermal energy of the drive fluid of the tool drive is initially transmitted to the respective coolant by a liquid-liquid heat exchanger and the latter is then cooled by the operating fluid. A possible introduction of the harmless coolant into the operating fluid and thus into the environment is less critical.

In another advantageous embodiment of the method according to the invention, the tool drive module is inserted into the container again after completing a respective tunnel construction project which can also include producing several individual tunnels. This way, the tool drive module can be removed in a particularly simple manner within the container from the tunnel construction site and moved e.g. to the next tunnel construction site or to the storage yard of the construction company.

Furthermore, the instant invention provides a method for producing a tunnel that uses the operating arrangement according to the invention, wherein the tool drive module is operated within the container. This operating mode is comparable in principle with an operating mode of a compact container, wherein the latter, however, does not use the operating arrangement according to the invention with two fluid tanks.

BRIEF DESCRIPTION OF THE DRAWINGS

The operating arrangement according to the invention and the method according to the invention are subsequently described based on an embodiment with reference to drawing figures, wherein.

DETAILED DESCRIPTION OF THE INVENTION

Figure 1:
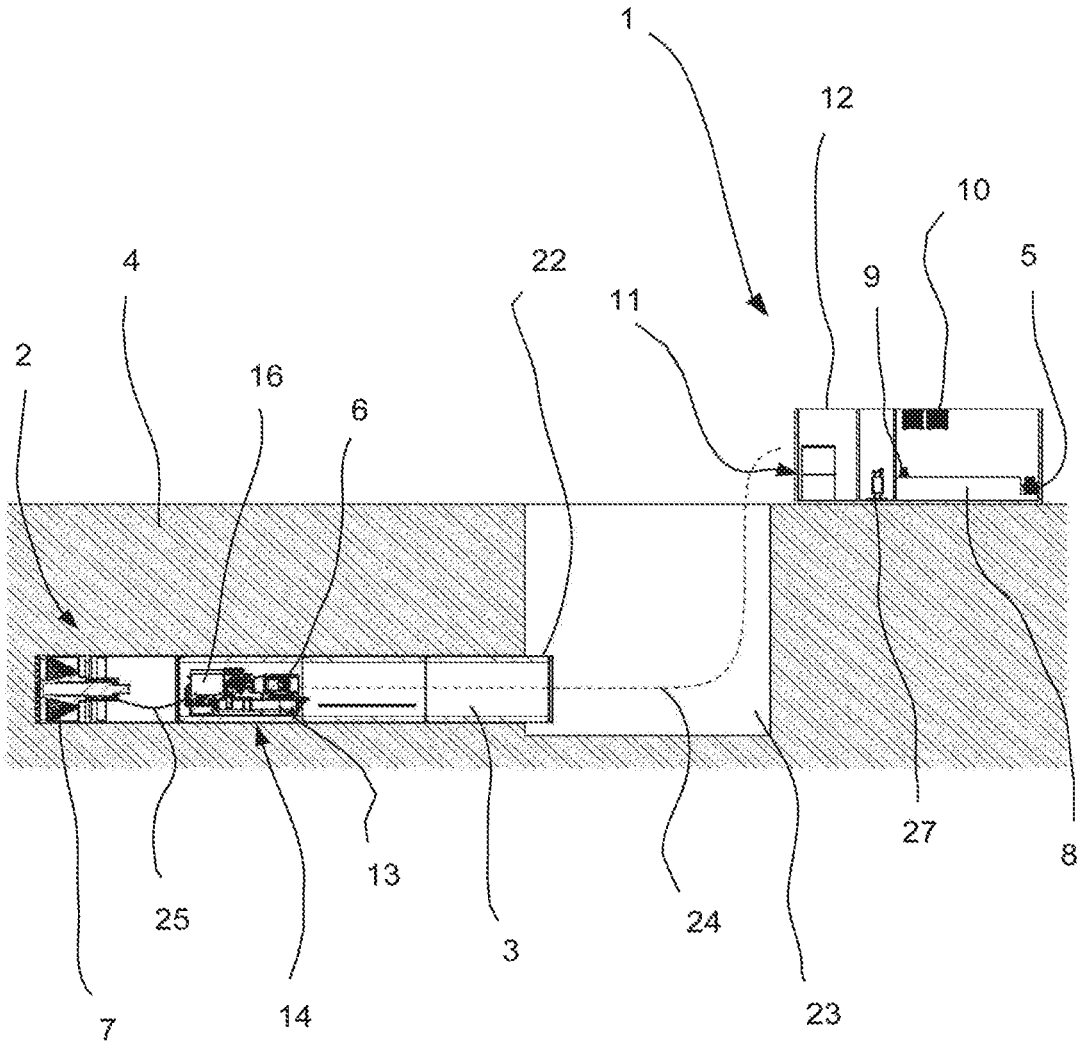
FIG. 1 illustrates a cross section of a tunnel construction site wherein a tool drive module is run behind a mining tool of an associated tunnel boring machine.
Figure 2:
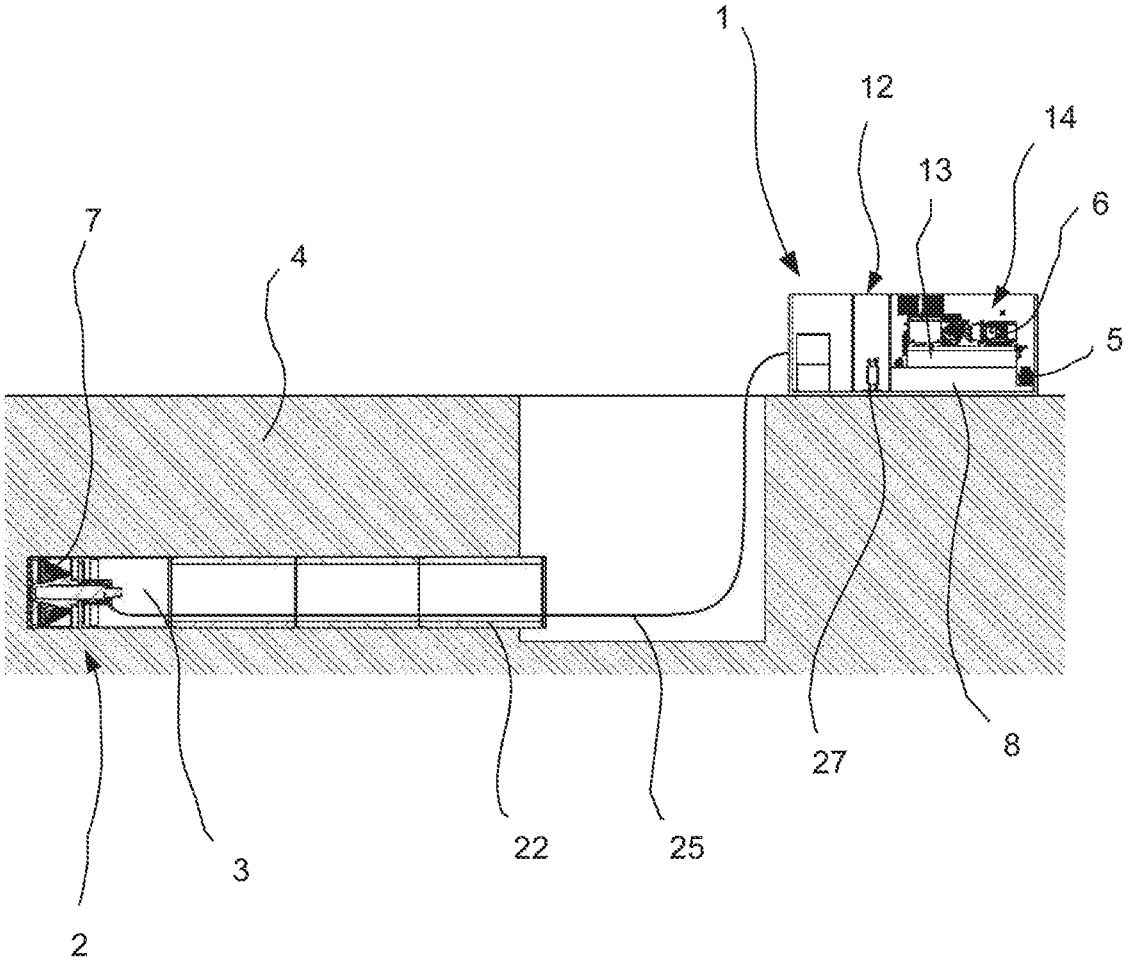
FIG. 2 illustrates the cross section according to FIG. 1, wherein the tool drive module is stored within a container that also includes the feed drive.
Figure 3:
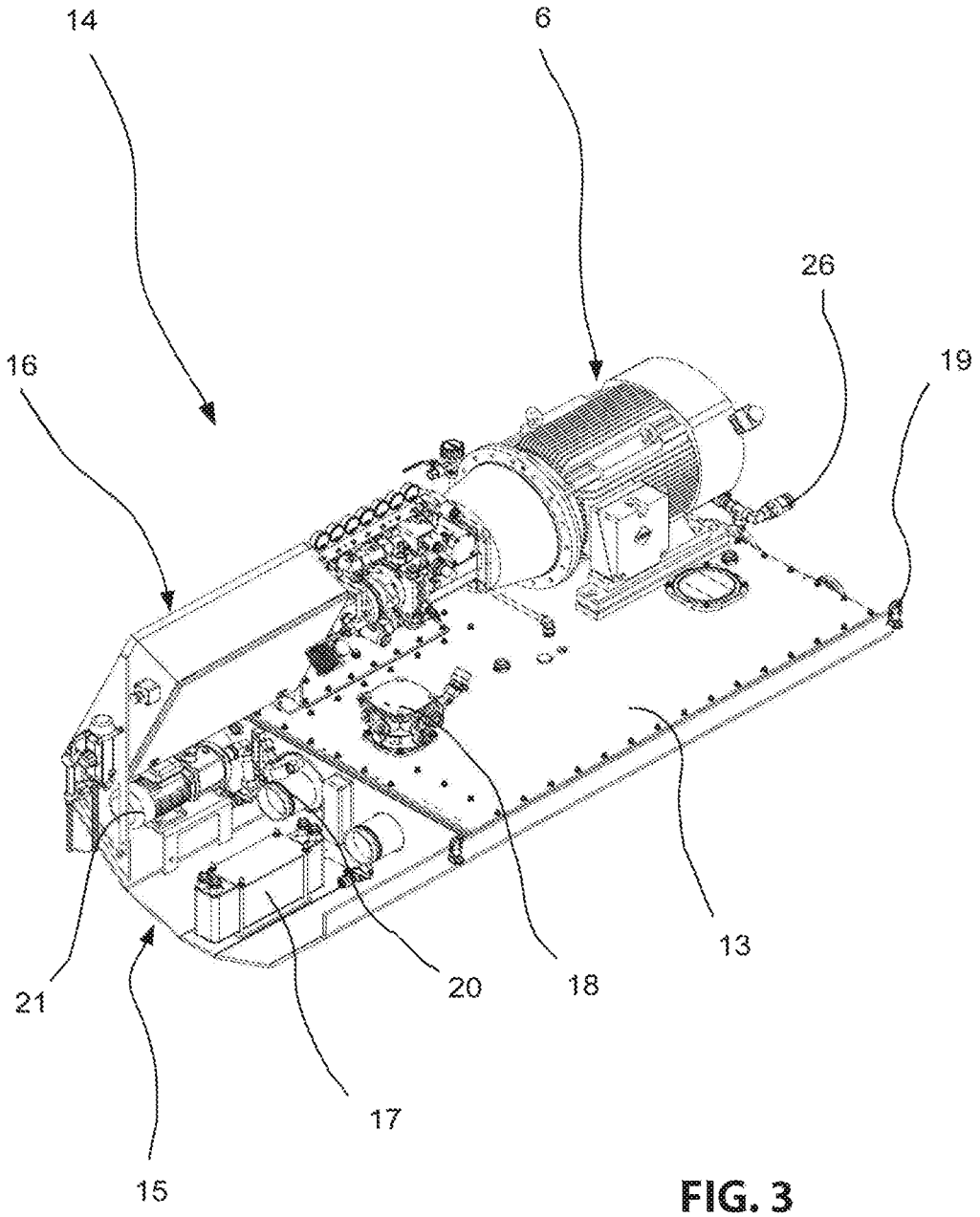
FIG. 3 illustrates a perspective view of a tool drive module.

The instant invention that is illustrated in FIGS. 1-3 includes an operating arrangement 1 according to the invention and a tunnel boring machine 2 for producing a tunnel 3 in a ground 4. The tunnel 3 that is to he produced is typically horizontal and has an inner diameter of 1.4 m. The operating arrangement 1 includes an above ground container 12 that is configured as a sea container, A feed drive 5 is arranged within the container 12 wherein the feed drive is configured to drive a feed press that is not illustrated in the drawing figures. The feed press is configured to be inserted into a starting shaft 23 and to provide the propulsion of the tunnel boring machine 2 in the ground 4 by cooperation with a tube segment 22 of the tunnel 3 that is oriented towards the feed press. A successive introduction of additional tube segments 22 into the tunnel 3 thus yields a finished tunnel 3 which is completely configured with tube segments 22 from beginning to end.

Within the container 12 of the operating arrangement 1 a fluid tank 8 for storing the operating fluid, a filtering arrangement 9 for filtering the drive fluid and a cooling arrangement 10 for cooling the drive fluid are permanently installed. The feed arrangement 5 is formed in the illustrated embodiment by a hydraulic unit that is operated by oil as a drive fluid. The cooling arrangement 10 is thus formed as an air liquid heat exchanger. Furthermore, the operating arrangement 1 includes a control arrangement 11 within the container 12 wherein the control arrangement provides control of the feed drive 5 as well as of the tool drive 6, the latter in the illustrated embodiment only indirectly which will be described in more detail infra.

In a condition of the operating arrangement that is illustrated in FIG. 1 a tool drive module 14 is illustrated that includes a tool drive 6 within the tunnel 3 behind a mining tool 7 of the tunnel boring machine 2. The tool drive module 14 which is evident in particular from FIG. 3 furthermore includes a tool drive 6 and a fluid tank 13 that is associated with the tool drive 6, a cooling arrangement 17 and a filtering arrangement 18. Thus, the tool drive 6 includes a proper fluid tank 13 which is configured completely independent from the fluid tank 8 of the feed drive 5. Thus, the feed drive 5 and the tool drive 6 have operating fluid loops that are completely decoupled from each other. The tool drive 6, the fluid tank 13, the cooling arrangement 17 and the filtering arrangement 18 are all configured as components of the tool drive module 14 in the illustrated embodiment. The latter furthermore includes a carrier unit 15 which is formed in the illustrated embodiment in a particular manner by the fluid tank 13. In the illustrated embodiment the structure of the fluid tank 13 simultaneously functions as the carrier unit 15 or vice versa the carrier unit 15 simultaneously functions as the fluid tank 13. The carrier unit 15 is provided with a plurality of carrier hooks 19 which facilitate a particularly simple transportation of the entire tool drive module 14, e.g. by a crane. The components of the tool drive module 14 are mounted in a force transmitting manner on the carrier unit 15.

Furthermore, the tool drive module 14 includes a control unit 16 that is configured to directly control the individual components of the tool drive module 14. Put differently, the control unit 16 forms a type of sub distributor to the control arrangement 11 so that operating the tool drive module 14 is also possible outside of the container 12 without having to run a plethora of individual control conduits directly from the control arrangement 11 to the respective individual components of the tool drive module 14 that have to be controlled. The control unit 16 is configured as a component of the tool drive module 14 and arranged on the carrier unit 15.

The operating situation of the operating arrangement 1 illustrated in FIG. 1 is provided in particular for producing long tunnels 3 wherein the length exceeds a certain threshold value which does not facilitate driving the mining tool 7 from the container 12 anymore. Accordingly, the tool drive module 14 as such is removed from the container 12 according to the invention and inserted into the tunnel 3 so that the tool drive module can run directly behind the mining tool 7. This has the advantage that hydraulic conduits 25 which connect the tool drive 6 with the mining tool 7 can be provided short in any case independently from a length of the tunnel 3. Thus, friction losses within the hydraulic conduits 25 can be reduced to a minimum.

The tool drive module 14 is configured in the illustrate embodiment so that it is coolable by an operating fluid of the tunnel boring machine 2 during tunnelling operations (FIG. 1) when it is arranged within the tunnel 3 that is being constructed. This relates to the cooling of the drive fluid of the tool drive 6. For this purpose, the tool drive module 14 includes a feed water conduit 20 and a liquid-liquid heat exchanger that cooperates with the feed water conduit 20 and that is not illustrated in the drawing figures. The feed water conduit 20 is run through the tool drive module 14 in the longitudinal direction of the tool drive module. The so called "feed water" thus forms the operating fluid of the tunnel boring machine 2. Cooling the operating fluid is performed in the illustrated embodiment by two stage cooling. The two stage cooling cools the operating fluid initially by the cooling arrangement 17 that is configured as a liquid-liquid heat exchanger. Using the cooling arrangement 17 heat is transferred from the drive fluid to a coolant which is formed herein by a water-glycol mix. The coolant is circulated by a coolant pump 21 and conducted from the cooling arrangement 17 into direct contact with an outer enveloping surface of the feed water conduit 20. Since the temperature of the feed water is rather low the feed water conduit 20 provides a heat transfer from the coolant through the feed water conduit 20 to the feed water which eventually extracts the thermal energy from the tool drive module 14. The temperature reduced coolant is then enabled again to receive thermal energy from the drive fluid of the tool drive 6 in the cooling arrangement 17.

It is particularly simple during operations of the tool drive module 14 within the container 12 to provide cooling of the drive fluid of the tool drive 6 by the cooling arrangement 10 that is permanently installed in the container 12. For this purpose, it is only required to connect coolant conduits of the cooling arrangement 10 for example to the cooling arrangement 17 of the tool drive module 14, in particular by quick connect clutches which can be connected to a connector 26 that is provided for this purpose. Excessive thermal energy of the coolant of the tool drive module 14 can then be extracted by the cooling arrangement 10 that is configured as an air liquid heat exchanger in the illustrated embodiment.

A connection of the tool drive module 14 with the container 12 is only performed by a conductor strand 24. In the illustrated embodiment according to FIG. 1 the conductor strand includes in particular a data conductor by which control signals of the control arrangement 11 can be transferred to the control unit 16 and two electrical conductors. The data conductor is used for providing the control unit 16 with electrical power wherein a voltage of 400 volts is provided to the control unit 16. The third conductor is used for supplying the tool drive 6 with electrical power wherein a higher voltage level of 960 volts is used due to the comparatively high power which is required by the tool drive 6 or its electric motor in order to avoid excessive power losses. A corresponding transformer 27 which transforms the external input voltage of 400 volts to the recited level of 960 volts is permanently installed in the container 12.

Alternatively, it is also conceivable to configure a transformer as a portion of the tool drive module 14 wherein this transformer would be suitable to transform a high voltage level e.g. 960 V to a lower voltage level, in particular 400 V. Supplying the control unit 16 could thus be directly performed by the tool drive module 14 so that the tool drive module 14 only requires a single electrical conductor in order to be supplied with electrical power.

The tool drive module 14, in particular its carrier unit 15 is configured so that the tool drive module 14 can be inserted into the container 12 or removed therefrom in its entirety without reconfiguration. Thus, the container 12 advantageously includes a corresponding receiver. A condition where the tool drive module 14 is arranged within the container 12 (container operations) can be derived in particular from FIG. 2. Since all components of the tool drive module 14 are arranged on the carrier unit 15 at locations that are respectively provided in the illustrated embodiment it comes as a consequence that the individual components do not change position relative to each other during insertion or removal of the tool drive module 14 into or from the container 12. In any case the tool drive module 14 is configured so that an operative connection can be continuously maintained between the tool drive 6 and the associated fluid tank 13.

An operating mode of the operating arrangement 1 as illustrated in FIG. 2 where the tool drive module 14 is continuously arranged within the container 12 can be used in particular when producing short tunnels 3. Tunnels of this type are short enough so that a maximum required length of hydraulic conduits 25 that connect the tool drive 6 with the mining tool 7 of the tunnel boring machine 2 does not exceed a respective threshold value which would cause a high level of friction loses within the hydraulic conduits 25. Therefore, these situations do not require an insertion of the tool drive module 14 into the tunnel 3 in the manner illustrated in FIG. 1.

Thus, the operating arrangement 1 according to the invention can be operated in a container mode (FIG. 2) as well as in a tunnel mode (FIG. 1) wherein a switching between the two operating modes is possible in a particularly quick and simple manner due to the uniform configuration of the tool drive module 14 with its carrier unit 15 and the adaptation of the configuration of the tool drive module 14 and a complementary receiver in the container 12. Providing a known tunnelling unit for producing long tunnels is therefore not required anymore when using the operating arrangement 1 according to the invention. Furthermore, it is not required anymore when producing a short tunnel to store a respective separate tunnelling unit that is known in the art outside of a protective encasement, e.g. a container and to expose it to weather and contamination that occur at a typical construction site. Furthermore, additional cost can be avoided which typically have to be borne by public contracting agencies, thus eventually by the public. Instead the tool drive module 14 of the operating arrangement 1 according to the invention can be easily inserted into the container 12 and is thus protected from external influences.

It is appreciated that the features recited supra in combination with the embodiment can be implemented independently from each other as a matter of principle and do not have to be used in the feature combinations described in a context with a particular embodiment.

REFERENCE NUMERALS AND DESIGNATIONS

1 operating arrangement
2 tunnel boring machine
3 tunnel
4 ground
5 feed drive
6 tool drive
7 mining tool
8 fluid tank
9 filtering arrangement
10 cooling arrangement
11 control arrangement
12 container
13 fluid tank
14 tool drive module
15 carrier unit
16 control unit
17 cooling arrangement
18 filtering arrangement
19 carrier hook
20 feed water conduit
21 coolant pump
22 tube segment
23 starting shaft
24 conductor strand
25 hydraulic conduit
26 connection
27 transformer

What is claimed is:

1. An operating arrangement for operating a tunnel boring machine for constructing a tunnel in a ground, the operating arrangement comprising:

a feed drive that is configured to propel the tunnel boring machine below the ground in a horizontal direction;

a tool drive that is configured to drive a mining tool of the tunnel boring machine to rotate so that a successive removal of the ground is performable;

at least one first fluid tank associated with the feed drive for storing a feed drive fluid;

at least one filtering arrangement for filtering the feed drive fluid;

at least one cooling arrangement for cooling the feed drive fluid;

at least one control arrangement by which the feed drive and the tool drive is controllable;

a tool drive module including the tool drive and a second fluid tank for a tool drive fluid for the tool drive so that the feed drive and the tool drive cooperate with the separate fluid tanks;

an above ground container that is configured to receive the feed drive, the at least one first fluid tank and the tool drive module in a storage configuration of the operating arrangement;

wherein the tool drive module is removed from the container in a boring configuration of the operating arrangement so that a fluid connection between the tool drive and the second fluid tank is maintained continuously and the tool drive module including the second fluid tank is configured to advance in the tunnel behind the mining tool, and wherein the container including the feed drive and the at least one first fluid tank is above ground and the tool module including the tool drive and the second fluid tank is below ground in the boring configuration of the operating arrangement.

2. The operating arrangement according to claim 1, wherein the tool drive module is removable from the container so that relative positions of at least one of the tool drive and the second fluid tank, or relative positions of all components of the tool drive module remain unchanged during removal.

3. The operating arrangement according to claim 1, wherein the tool drive module includes a carrier unit on which at least the tool drive and the second fluid tank, or all components of the tool drive module are arranged.

4. The operating arrangement according to claim 3, further comprising:

a receiver for the tool drive module, wherein the receiver is configured in the container and adapted to the carrier unit so that the carrier unit is mountable without reconfiguration in or at the receiver and dismountable from the receiver without reconfiguration.

5. The operating arrangement according to claim 1, further comprising:

a control unit that is associated with the tool drive and configured as a component of the tool drive, wherein the control unit respectively includes a connection with the control arrangement as well as with the tool drive so that the control unit is configured to receive control signals from of the control arrangement and to electrically control the tool drive according to the control signals received from the control arrangement.

6. The operating arrangement according to claim 5, wherein the control unit is operatively connected by the connection with three input conduits at the most, namely with at least one data conductor for connecting the control unit with the control arrangement and at least one electrical conductor for supplying the control unit with electrical energy.

7. The operating arrangement according to claim 1, further comprising:

a second cooling arrangement for the tool drive fluid for the tool drive, wherein the second cooling arrangement is provided as a component of the tool drive module.

8. The operating arrangement according to claim 1, further comprising:

a second filtering arrangement for the tool drive fluid for the tool drive, wherein the second filtering arrangement is directly flow connected with the second fluid tank that is associated with the tool drive, wherein the second filtering arrangement is provided as a component of the tool drive module.

9. The operating arrangement according to claim 1, further comprising:

at least one transformer which is associated only with the tool drive, wherein the at least one transformer provides an output voltage of 960 volts.

10. A method for producing the tunnel in the ground by the operating arrangement according to claim 1, the method comprising the steps:

retrieving the tool drive module which includes the tool drive and the second fluid tank that cooperates with the tool drive from the container which includes the feed drive in addition to the tool drive, wherein the tunnel boring machine is advanceable in the ground by the feed drive;

inserting the tool drive module into the tunnel that is being produced; and running the tool drive module including the fluid tank that cooperates with the tool drive behind the mining tool during a tunnel advance.

11. The method according to claim 10, wherein the tool drive module is reinserted into the container after completion of the tunnel and before construction of a second tunnel.

12. The method according to claim 10, wherein the tool drive module is inserted into the container again after completion of a respective tunnel project wherein the feed drive and the tool drive are advantageously jointly removed from a set-up location of the container in the container.

13. A method for producing the tunnel in the ground using the operating arrangement according to claim 1, the method comprising:

arranging the tool drive module in the container and operating the tool drive module in the container.

14. A method for producing a tunnel in a ground by a tunnel boring machine, the method comprising the steps:

retrieving a tool drive module which includes at least one tool drive and a fluid tank that cooperates with the tool drive from a container which includes a feed drive in addition to the tool drive, wherein the tunnel boring machine is advanceable in the ground by the feed drive;

inserting the tool drive module into the tunnel that is being produced; and running the tool drive module including the fluid tank that cooperates with the tool drive behind a mining tool during a tunnel advance;

wherein a drive fluid of the tool drive is cooled during a first start up period in which an initial section of the tunnel is produced by a first cooling arrangement that is permanently installed in the container and cooled during a propulsion period after the start up period in which the tool drive module is run behind the mining tool by a second cooling arrangement that is arranged at the tool drive module.

15. The method according to claim 14, wherein the drive fluid of the tool drive is cooled during the start-up period at least indirectly by an air-liquid heat exchanger and during the propulsion period indirectly by an operating fluid of the tunnel boring machine.

* * * * *